United States Patent [19]

Streich et al.

[11] 4,250,966

[45] Feb. 17, 1981

[54] INSERTION TYPE CEMENTING BAFFLE

[75] Inventors: Steven G. Streich; Lloyd C. Knox, both of Duncan, Okla.

[73] Assignee: Halliburton Company, Duncan, Okla.

[21] Appl. No.: 114,810

[22] Filed: Jan. 24, 1980

[51] Int. Cl.[3] ..... E21B 23/00; E21B 33/14; E21B 34/06; E21B 43/01

[52] U.S. Cl. ..... 166/328; 166/242; 166/285

[58] Field of Search ..... 166/285, 289, 290, 242, 166/327, 328, 329; 405/233, 236, 248

[56] References Cited

U.S. PATENT DOCUMENTS

| | | | |
|---|---|---|---|
| 1,063,942 | 6/1913 | Phillips | 405/248 |
| 2,593,520 | 4/1952 | Baker et al. | 166/328 X |
| 3,347,319 | 10/1967 | Littlejohn | 166/290 X |
| 3,415,322 | 12/1968 | Putch | 166/242 X |
| 3,545,543 | 12/1970 | Kammerer, Jr. | 166/242 X |

*Primary Examiner*—Stephen J. Novosad
*Attorney, Agent, or Firm*—John H. Tregoning; James R. Duzan

[57] ABSTRACT

An insertion type cementing baffle comprising a baffle housing and insertion type cementing baffle member.

10 Claims, 2 Drawing Figures

INSERTION TYPE CEMENTING BAFFLE

This invention relates to an insertion type cementing baffle for use in the cementing of the conductor pipes of offshore platforms into subterranean formations.

The wells drilled from an offshore platform are drilled through conductor pipes which extend from the deck of the platform to the seabed and into the seabed. In many instances, it is necessary to drill an initial hole into the seabed into which the conductor pipe is inserted and secured therein by cementing it to the subterranean formations.

The drilled holes into which the conductor pipes are inserted are usually drilled by lowering a conductor pipe string from the deck of the offshore platform to the seabed, inserting a drill string having an underreaming type drill bit installed on the end thereof through the conductor pipe, and drilling a hole which is larger than conductor pipe utilizing the underreaming type drill bit. During the drilling process the conductor pipe is utilized to guide the drill pipe and underreaming type drill bit.

After the hole has been drilled to the desired depth by the underreaming type drill bit, in order to cement the conductor pipe into the hole the drill string and bit must be withdrawn; the conductor pipe pulled from the hole so that standard floating cementing equipment, having a back pressure valve therein, can be installed on the end of the conductor pipe; and the conductor pipe reinserted into the drilled hole.

Since it is a very time-consuming and laborious process to remove the conductor pipe from the drilled hole to install standard floating cementing equipment on the conductor pipe and to again insert the conductor pipe into the previously drilled hole, the insertion type cementing baffle of the present invention was developed to eliminate the pulling of the conductor pipe after the drilling of the hole and before the cementing of the conductor pipe into the subterranean formation. The insertion type cementing baffle of the present invention comprises a baffle housing and insertion type cementing baffle member.

The advantages of the present invention and the preferred embodiment thereof will be better understood from the following specification taken in conjunction with the accompanying drawings wherein.

Figure 1:
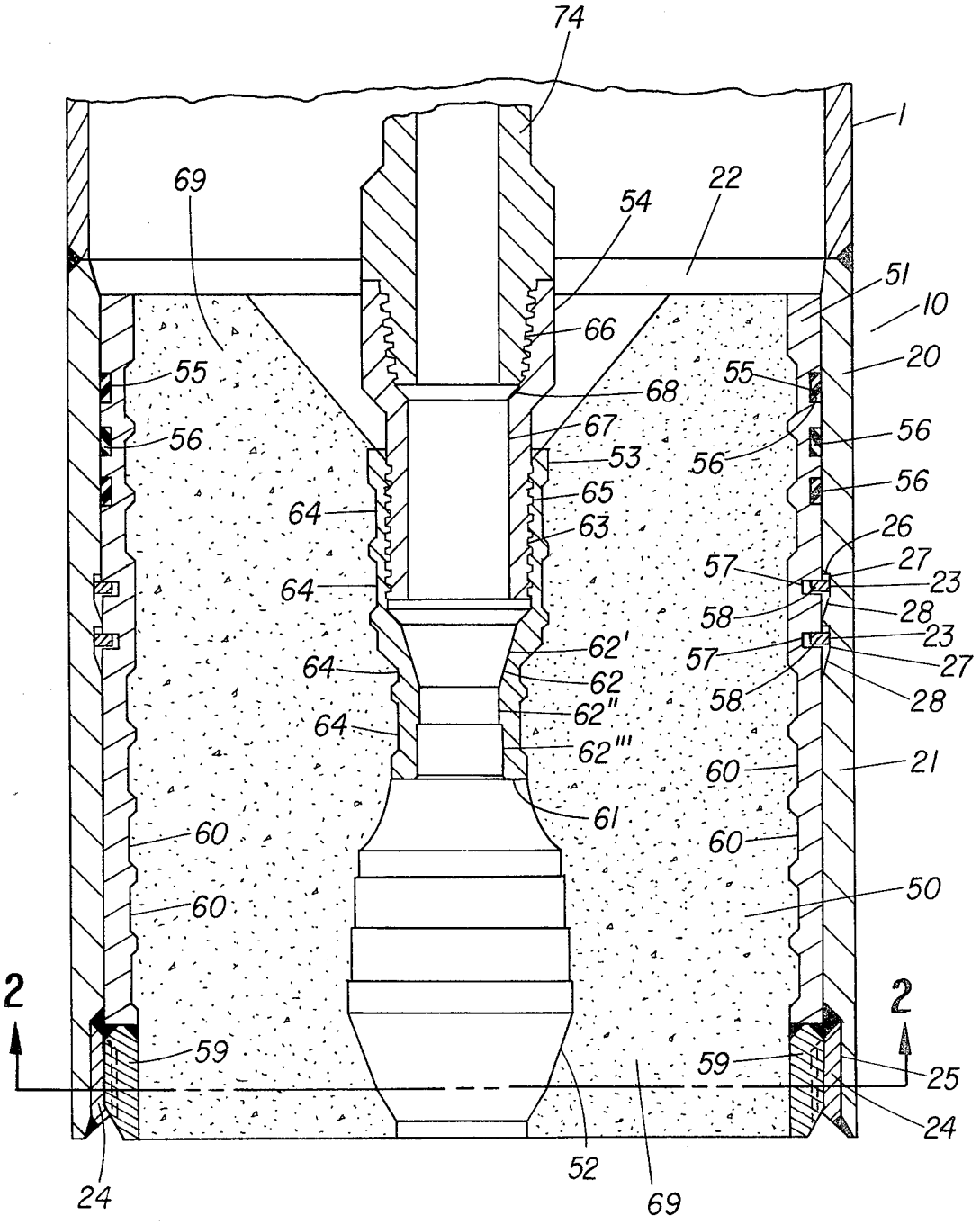
FIG. 1 is a cross-sectional view of the preferred embodiment of the present invention.

Referring to FIG. 1, the present invention is shown in its preferred embodiment.

The insertion type cementing baffle 10 of the present invention comprises a baffle housing 20 and insertion type cementing baffle member 50.

The baffle housing 20 comprises an annular member 21 having annular chamfered surface 22 on the interior surface of one end thereof, a plurality of annular grooves 23 located on the interior surface thereof, and a plurality of locking lugs 24 on the interior surface of the other end thereof retained in annular recess 25 therein. The annular grooves 23 each comprise an annular recess having an annular abutment shoulder 26, cylindrical portion 27 and chamfered annular shoulder 28.

The baffle housing 20 may be secured to the conductor pipe 1 by any suitable means, such as welding, so long as the exterior surface of the conductor pipe 1 and the exterior surface of the baffle housing 20 are substantially the same and provide a substantially smooth surface to allow the easy movement of the baffle housing 20 in the drilled hole for the conductor pipe 1.

The baffle housing 20 may be constructed of any suitable material, although steel is preferred.

The insertion type cementing baffle member 50 comprises an annular baffle member 51, float valve means 52, sealing sleeve means 53 and sealing adapter means 54.

The annular baffle member 51 is formed having a plurality of annular recesses 55 having annular seal means 56 therein on the exterior surface thereof, a plurality of annular recesses 57 having annular resilient locking ring means 58 therein on the exterior surface thereof, a plurality of locking lugs 59 on one end thereof and a plurality of annular channels 60 on the interior surface thereof.

The baffle member 51 may be formed of any suitable material, although an easily drillable material such as aluminum is preferred.

The annular seal means 56 may be any suitable type annular elastomeric type seal means, such as an annular elastomeric O-ring type seal means.

The locking lugs 59 may be of any suitable easily drillable material.

The annular resilient locking ring means 58 may be of any suitable easily drillable material.

The float valve means 52 may be any suitable easily drillable type check valve means which is capable of preventing fluid flow in one direction through the check valve means while allowing fluid flow in the other direction through the check valve means.

Abutting the inlet 61 of the float valve means 52 is sealing sleeve means 53. The sealing sleeve means 53 is formed having a bore 62 through a portion thereof, a left-hand threaded interior portion 63 and a plurality of annular recesses 64 in the exterior thereof. The sealing sleeve means 53 may be of any exterior geometric configuration so long as bore 62 therein mates with the inlet 61 of float valve means 52 and contains a left-hand threaded interior portion 63. The sealing sleeve 53 may be formed of any suitable material, although it is preferable that it is formed of an easily drillable material. It is preferred that bore 62 of the sealing sleeve means 53 be formed to serve as a receiver for a conventional latch-down plug means during conductor pipe cementing operations. If bore 62 is to be used as a receiver for a latch-down plug means the bore 62 must be formed having a conically shaped inlet portion 62', first cylindrical portion 62'' and second cylindrical portion 62''' which has a larger diameter than first cylindrical portion 62''.

Mating with the left-hand threaded interior portion 63 of sealing sleeve 52 is left-hand threaded exterior portion 65 of sealing adapter means 54. The sealing adapter means 54 is formed having left-hand threaded exterior portion 65, right-hand threaded interior portion 66 and bore 67 having chamfered inlet 68. The sealing adapter means 54 may be formed of any suitable material preferably steel.

The float valve means 52 and sealing sleeve means 53 are concentrically retained in the interior of annular baffle member 51 by material retaining means 69. The material retaining means 69 may be any suitable type material which is easily mixed, shaped, bonds to annular baffle member 51, float valve means 52 and sealing sleeve 53, and which is easily drillable, such as a concrete blend.

Figure 2:
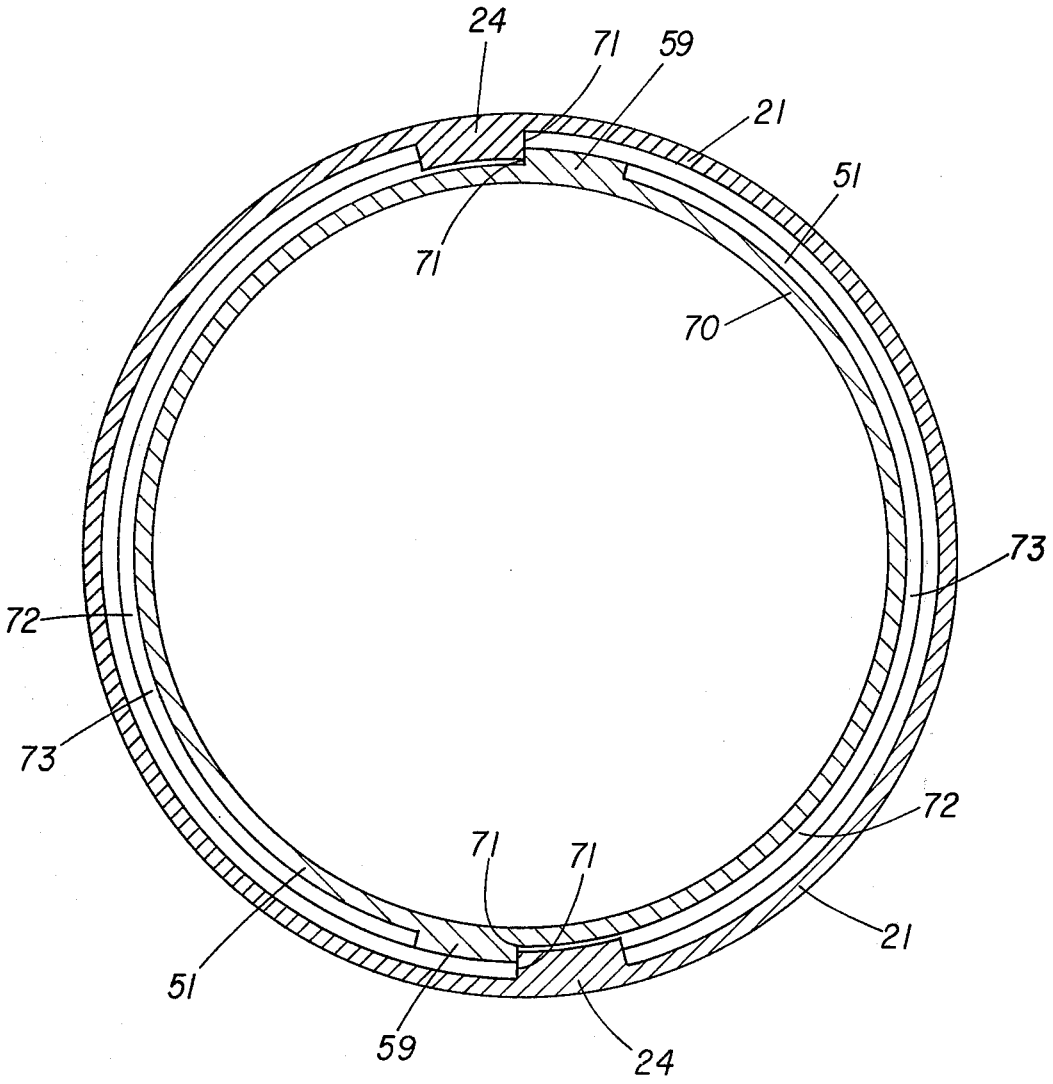
FIG. 2 is a cross-sectional view of the preferred embodiment of the present invention taken along lines 2—2 of FIG. 1.

Referring to FIG. 2, the relationship between the locking lugs 24 on the baffle housing 20 and the locking lugs 59 on the annular baffle member 51 can be seen. Any number of locking lugs 59 may be formed on an annular member 70 which is secured to the annular baffle member 15, such as by welding. Similarly, any number of locking lugs 24 may be formed on baffle housing 21. When the annular baffle member 51 is installed in the baffle housing 21, the complementary faces 71 of the lugs 24 and 59 will, upon rotation of the annular baffle member 51, abut. It should be further noted that locking lugs 24 on the baffle housing 21 extend radially inward into semiannular recesses 72 between locking lugs 59 on the cementing baffle member 50, thereby limiting the movement of the cementing baffle member 50 with respect to the baffle housing 21 in one direction by the end surfaces of the locking lugs 24 abutting semiannular surfaces 73 of the cementing baffle member 50.

Referring again to FIG. 1, the installation of the cementing baffle member 51 in the baffle housing 21 will be discussed.

The baffle housing 21 is initially installed to the end of a string of conductor pipe 1, usually by welding, before the underreaming drilling operation commences. After the drilling operation is completed, the drill string is removed from the conductor pipe string leaving the baffle housing 1 on the lower end thereof.

At this time, the cementing baffle member 50 is threadedly engaged by drill pipe string 74 and installed thereon. The cementing baffle member 50 is lowered through the conductor pipe string and inserted into the baffle housing 21. When inserted in the baffle housing 21, the resilient locking ring means 58 on the cementing baffle member 21 engage annular groove 23 located on the interior surface of baffle housing 20 and locking lugs 59 on the cementing baffle member engage locking lugs 24 on the baffle housing. The movement of the cementing baffle member with respect to the baffle housing 21 is limited in one direction by the semiannular surfaces 73 of the cementing baffle member 50 abutting the end surfaces of locking lugs 24 of the baffle housing 21 while movement in the other direction is limited by the resilient locking rings 58 abutting surface 26 of the annular recesses 23 in the baffle housing 21. When the cementing baffle member 50 is installed in the baffle housing 21, the seal means 56 sealingly engage the interior of baffle housing 21.

At this point, cement is flowed down through the drill pipe string 74, through the sealing adapter means 54, through the sealing sleeve means 53, through float valve means 52 and out the cement baffle member 50 to cement the conductor pipe string 1 to the surrounding subterranean formation. Once the desired amount of cement has been flowed or displaced through the drill pipe string 1 and cementing baffle member 50, a latch-down plug means (not shown) may be displaced through the drill pipe string 74 and landed in sealing sleeve means 53 being retained therein. By utilizing a latch-down plug means which is landed in and retained by the sealing sleeve means 53, if the float valve means 52 fails to contain the pressure from the cement on the exterior of the cementing baffle 10 and conductor pipe string 1, a secondary seal to contain the pressure from the cement has been provided.

After the latch-down plug means has been landed in sealing sleeve means 53, the drill pipe string 74 is rotated to the right which unscrews left-hand threaded portion 65 of the sealing adapter 54 from left-hand threaded portion 63 of sealing sleeve means 53. Once the sealing adapter 54 no longer engages sealing sleeve 53, the drill pipe string 74 may be removed from the conductor pipe string 1, thereby leaving the cementing baffle 10 retaining the cement slurry between the conductor pipe string 1 and the surrounding subterranean formation until it solidifies. When sufficient time has passed from the cement slurry to solidify to the desired level of strength, a drill on the end of a drill pipe string is lowered through the conductor pipe string 1 and the cementing baffle member 50 is drilled out of the baffle housing 21. It should be noted that when drilling out the cementing member 50 from the baffle housing 21, the locking lugs 24 abutting lugs 59 prevent rotation of the cementing baffle member 50 with respect to the baffle housing 21.

It should be noted that although the cementing baffle of the present invention has been described in relation to the conductor pipe string of an offshore platform, the cementing baffle may be used in any situation where it is desired to insert a cementing baffle member into the baffle housing after the tubular string to which the baffle housing is secured has been inserted into the subterranean formation into which it is to be cemented.

Having thus described my invention, I claim:

1. A cementing baffle for controlling the flow of cement slurry for the cementing of a tubular member in a subterranean formation, said cementing baffle being secured to said tubular member and having said flow of cement slurry directed thereto by tubing means, said cementing baffle comprising:

annular baffle housing means having annular groove means about the interior surface thereof and having locking lug means about the interior surface on one end of said annular baffle housing means extending radially inward therefrom; and cementing baffle member means insertable within said annular baffle housing means, said cementing baffle member means comprising:

annular baffle member means having seal means on the exterior thereof engaging the interior surface of said annular baffle housing means when said cementing baffle member means is inserted therein and having locking means on the exterior thereof engaging the groove means about the interior surface of said annular baffle housing means when said cementing baffle member means is inserted therein;

locking lug means on one end of said cementing baffle member means for engaging the locking lug means about the interior surface on one end of said annular baffle housing means when said cementing baffle member means is inserted therein;

sealing sleeve means secured within the annular baffle member means, the sealing sleeve means having a bore therethrough to allow said flow of cement slurry through said cementing baffle member means; and sealing adapter means adapted to be releasably connected to said tubing means and adapted to be releasably connected to the sealing sleeve means.

2. The cementing baffle of claim 1 wherein said cementing baffle member means further comprises:

float valve means for controlling said flow of cement slurry in one direction through said cementing baffle while allowing said flow of cement slurry in the other direction therethrough.

3. The cementing baffle of claim 2 wherein the float valve means comprise one-way check valve means.

4. The cementing baffle of claim 2 wherein said cementing baffle member means further comprises:

material retaining means securing the sealing sleeve means and float valve means to the annular baffle member means.

5. The cementing baffle of claim 4 wherein the material retaining means comprises a concrete blend.

6. The cementing baffle of claim 1 wherein the seal means on the annular baffle member means comprise annular elastomeric seal means.

7. The cementing baffle of claim 1 wherein one end of the annular baffle member means abuts the locking lug means about the interior surface on one end of said annular baffle housing means when said cementing baffle member means is inserted within said annular baffle housing means to prevent the movement in one direction of said cementing baffle member means with respect to said annular baffle housing means.

8. The cementing baffle of claim 7 wherein the locking means on the exterior surface of the annular baffle member means when engaging the annular groove means about the interior surface of said annular baffle housing means when said cementing baffle member means is inserted within said annular baffle housing means prevent the movement in the other direction of said cementing baffle member means with respect to said annular baffle housing means.

9. The cementing baffle of claim 1 wherein the locking means on the exterior of the annular baffle member means comprises resilient annular locking ring means.

10. A cementing baffle for controlling the flow of cement slurry for the cementing of a conductor pipe string in a subterranean formation, said cementing baffle being secured to said conductor pipe string and having said flow of cement slurry directed thereto by a drill pipe string, said cementing baffle comprising:

annular baffle housing means having annular groove means about the interior surface thereof and having locking lug means about the interior surface on one end of said annular baffle housing means extending radially inward therefrom; and cementing baffle member means insertable within said annular baffle housing means, said cementing baffle member means comprising:

annular baffle member means having elastomeric seal means on the exterior thereof engaging the interior surface of said annular baffle housing means when said cementing baffle member means is inserted therein and having resilient annular locking ring means on the exterior thereof engaging the groove means about the interior surface of said annular baffle housing means when said cementing baffle member means is inserted therein, thereby preventing the movement in one direction of said cementing baffle member means with respect to said annular baffle housing means;

locking lug means on one end of said cementing baffle member means for engaging and abutting the locking lug means about the interior surface on one end of said annular baffle housing means when said cementing baffle member means is inserted therein, thereby preventing movement in the other direction of said cementing baffle member means with respect to said annular baffle housing means;

sealing sleeve means secured within the annular baffle member means, the sealing sleeve means having a bore therethrough to allow said flow of cement slurry through said cementing baffle member means;

sealing adapter means adapted to be releasably connected to said tubing means and adapted to be releasably connected to the sealing sleeve means;

float valve means for controlling said flow of cement slurry in one direction through said cementing baffle while allowing said flow of cement slurry in the other direction therethrough; and material retaining means securing the sealing sleeve means and float valve means to the annular baffle member means.

* * * * *